US006517064B2

(12) United States Patent
Glanzmann

(10) Patent No.: US 6,517,064 B2
(45) Date of Patent: Feb. 11, 2003

(54) DEVICE FOR GATHERING AND CONVEYING PRINTED SHEETS STRADDLING A GATHERING SEGMENT

(75) Inventor: Alfred Glanzmann, Reiden (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/838,155

(22) Filed: Apr. 20, 2001

(65) Prior Publication Data

US 2001/0033051 A1 Oct. 25, 2001

(30) Foreign Application Priority Data

Apr. 20, 2000 (EP) ..... 00810347

(51) Int. Cl.[7] ..... B42B 2/00

(52) U.S. Cl. ..... 270/52.28; 270/52.26; 270/52.27

(58) Field of Search ..... 271/233; 270/52.26, 270/52.29, 52.3, 52.27, 52.28; 198/644

(56) References Cited

U.S. PATENT DOCUMENTS 1,614,717 A * 1/1927 Christensen ..... 198/644
3,663,007 A * 5/1972 Preiter ..... 270/52.3
4,493,482 A 1/1985 Valenti et al.
5,028,193 A * 7/1991 Misicka ..... 412/37
5,501,442 A 3/1996 Mandel
5,678,813 A 10/1997 Osako et al.

* cited by examiner

*Primary Examiner*—Kathy Matecki
*Assistant Examiner*—Michael Lowe
(74) *Attorney, Agent, or Firm*—Robert Kinberg; Venable, LLP

(57) ABSTRACT

A device is provided for gathering and conveying printed sheets over a conveying path. The device includes a gathering segment, with the legs of the printed sheets straddling the gathering segment. The gathering segment includes a conveyor device having a saddle-shaped support surface for receiving the printed sheets and is adaptable to be loaded by sheet feeders disposed along the gathering segment, and driven carriers disposed on the conveyor device having a guide apparatus to raise at least one leg of at least one of the printed sheets to define first printed sheets without raised legs and a second printed sheets with raised legs. The device further includes a stop apparatus projecting into the conveying path of the second printed sheets and griping the front edges of the second printed sheets, wherein the stop apparatus is adaptable to be shut off when the first printed sheets are conveyed past.

14 Claims, 2 Drawing Sheets

DEVICE FOR GATHERING AND CONVEYING PRINTED SHEETS STRADDLING A GATHERING SEGMENT

CROSS REFERENCE TO RELATED APPLICATIONS

Priority is claimed with respect to European Patent Application No. 00810347.5 filed on Apr. 20, 2000, in the European Patent Office, the disclosure of which is herein incorporated by reference.

BACKGROUND OF THE INVENTION

The present invention relates to a device for gathering and conveying printed sheets straddling a gathering segment. The device is formed by a conveyor apparatus that is loaded by sheet feeders disposed along a gathering segment, the apparatus having a saddle-shaped support surface for the printed sheets and driven carries.

Devices of this type are used in, for example, gathering and stapling machines, in which a stapling apparatus adjoins the gathering segment.

When the conveyor apparatus of a gathering segment is loaded, the printed sheets transferred by the sheet feeder are often not set down with their rear edge, seen in the conveying direction, at the associated carrier of the conveyor apparatus. Instead, the rear edges of the printed sheets fed by the sheet feeders are set down at a distance in front of sheets already on the conveyor. Or, the printed sheets are set down onto the conveyor apparatus askew due to the dynamic forces occurring upon impact with the carrier or due to a sudden halt in machine operation. Accordingly, the rear edges of the printed sheets fed by the sheet feeders do not align with the rear edges of the printed sheets being conveyed. Previous counteractive measures included slowing the printed sheets fed by the sheet feeders with elements such as brushes or springs that grip the printed sheets by the free-standing surface in a frictional connection and transfer them into a rear end position at the carriers. Often, the sliding behavior between the printed sheets and/or different format sizes will render the elements acting on the printed sheets through friction inadequate for uniformly arranging the printed sheets at the carriers.

In view of the above, it is an object of the present invention to remedy the described drawbacks with an advantageous device.

SUMMARY OF THE INVENTION

A device for gathering and conveying a plurality of printed sheets over a conveying path, each sheet having a front edge and a rear edge with respect to a direction of conveyance is provided. The device includes a conveyor device presenting a gathering segment and having a saddle-shaped support surface adaptable to be loaded by sheet feeders disposed along the gathering segment with a plurality of sheets that have legs straddling the saddle-shaped support surface; driven carriers disposed on the conveyor device and spaced apart from one another, wherein the rear edge of at least one of the sheets straddling the saddle-shaped support along the gathering segment is separated from an associated driven carrier; a guide apparatus arranged to raise at least one leg of the at least one sheet away from the saddle-shaped support surface; and a stop apparatus projecting into the conveying path of the at least one raised leg and gripping the front edge of the at least one raised leg, wherein the stop apparatus is removed from the conveying path by the at least one sheet.

The present invention considerably improves reliability of a common reference position of the printed sheets for further processing.

The present invention also includes a method for gathering and conveying printed sheets straddling a gathering segment, on which a plurality of sheet feeders is disposed. The sheet feeders consecutively load printed sheets onto a conveyor apparatus that comprises a saddle-shaped support surface and carriers that are secured to a circulating tension element. At least one leg of a printed sheet supplied to the gathering segment is held at a distance from the support surface, and the sheet is not placed onto the support surface until a stop apparatus acts on the front edge of the printed sheet.

Furthermore, it is possible to allocate the first sheet feeder only one stop apparatus, which grips the printed sheet lying on the support surface by the front edge of the one leg.

Because sheet feeders are exchangeable, it can also be practical to allocate a first sheet feeder an entire transfer apparatus.

In cases where the gathered printed sheets do not have a common defintion position at the end of the gathering segment, a stop apparatus associated with the gathering segment can project into the conveying path of the gathered printed sheets adjoining the last sheet feeder in the conveying direction.

BRIEF DESCRIPTION OF THE DRAWINGS

The invention is described below by way of a preferred embodiment in conjunction with the drawings.

DETAILED DESCRIPTION OF THE INVENTION

Figure 1:
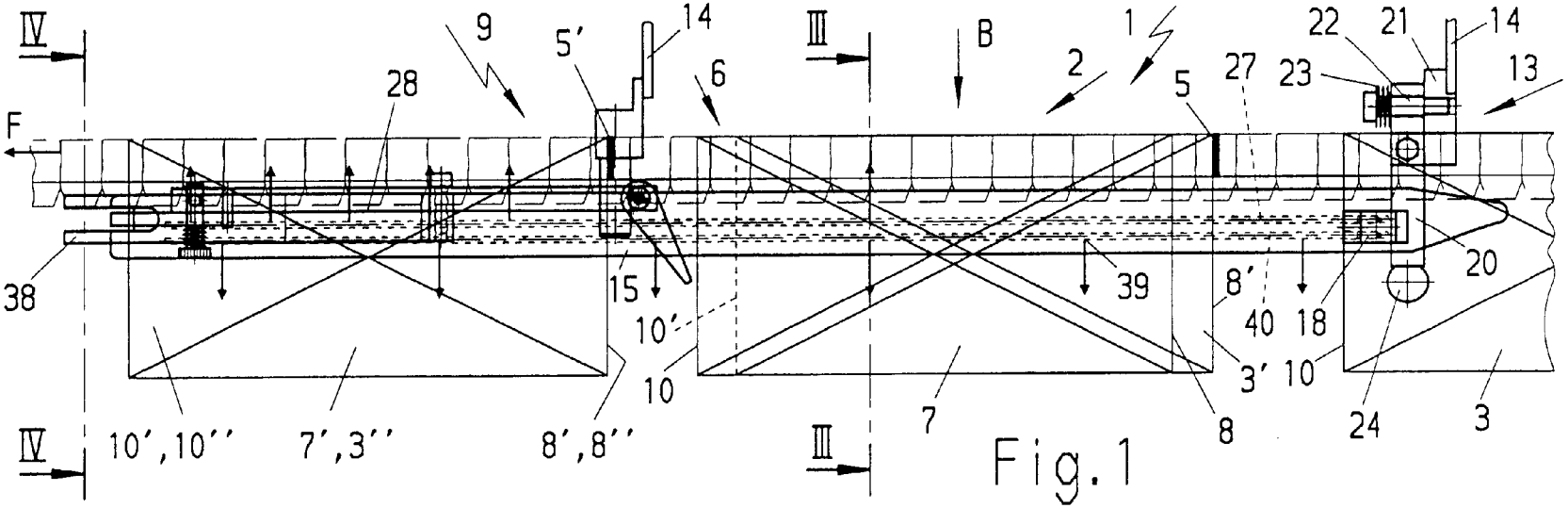
FIG. 1 is a side view of the device according to the invention.
Figure 2:
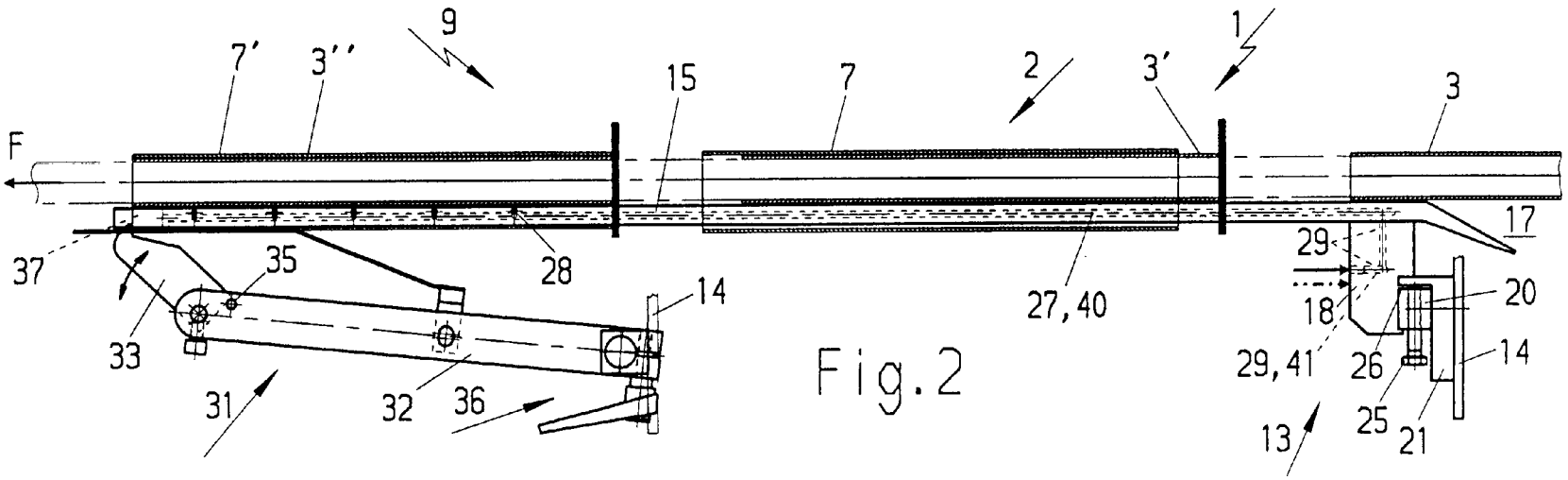
FIG. 2 is a plan view of the device shown in FIG. 1.

FIGS. 1 and 2 illustrate the device 1 of the invention including a gathering segment 2 shown in a partial side view of a conveyor apparatus. The device gathers printed sheets, for example, in a gathering and stapling machine. The gathering segment is formed by a saddle-shaped, drivable or stationary support surface 4 and a conveyor apparatus 6 having carriers 5, which are secured to continuously-circulating tension elements, for gathering and conveying printed sheets in a straddling position.

Figure 3:
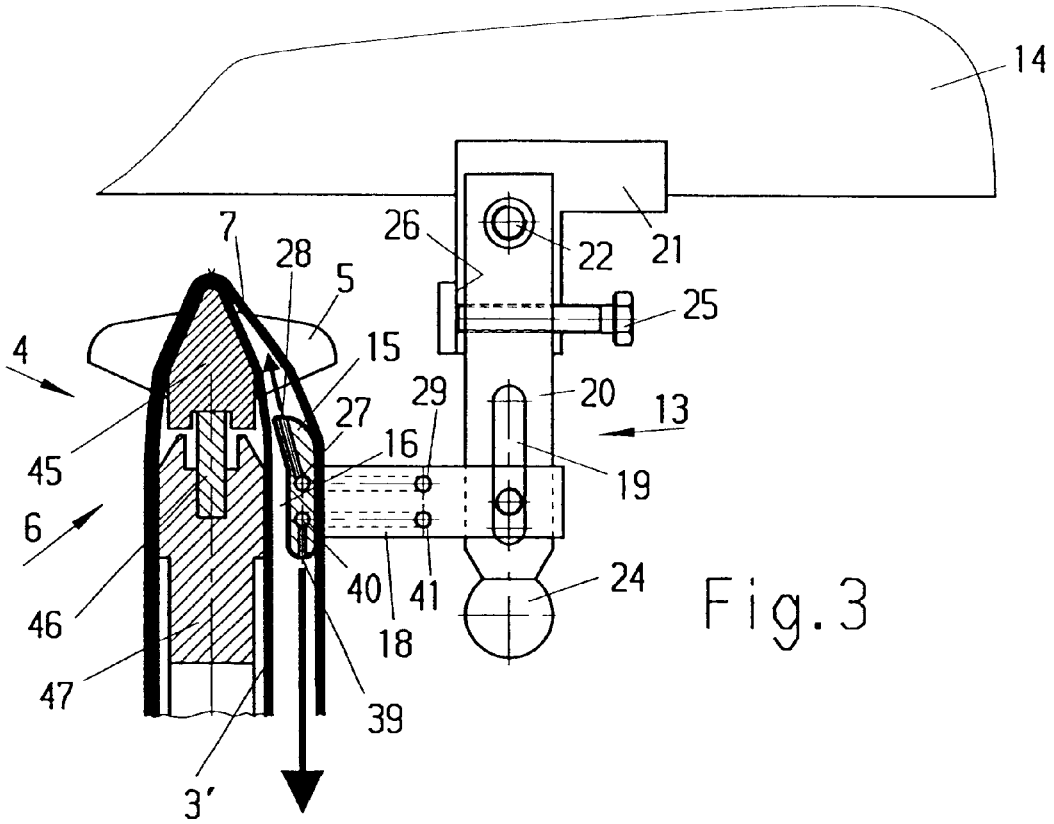
FIG. 3 is a cross section of the device along the line III—III in FIG. 1.
Figure 4:
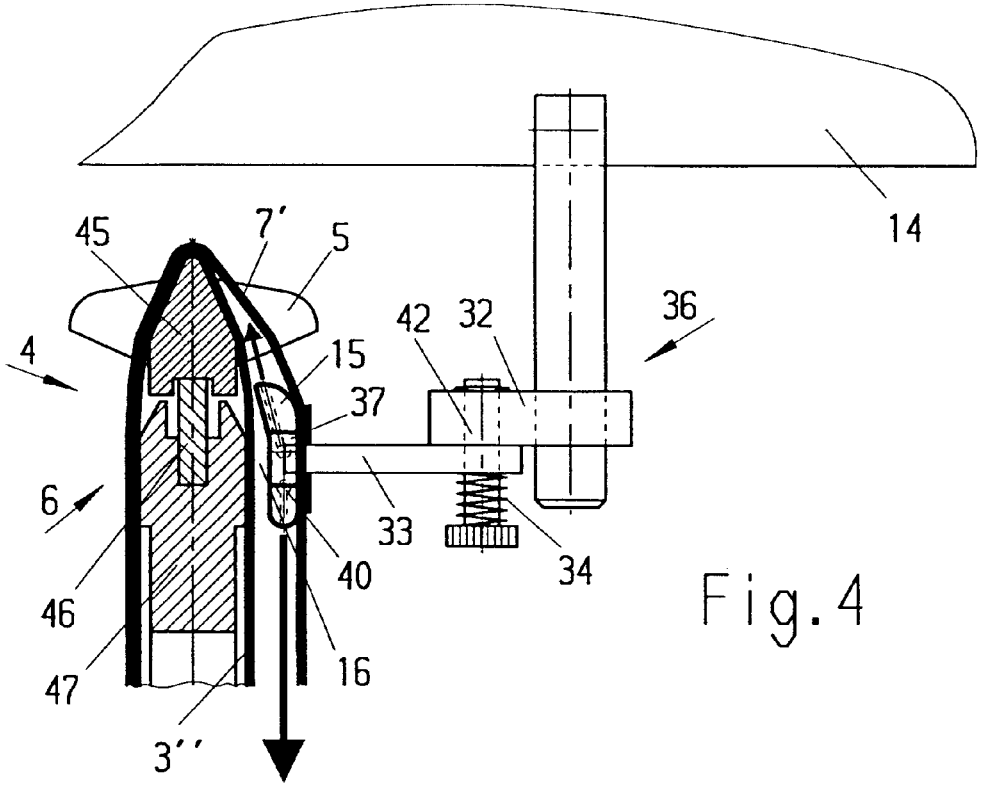
FIG. 4 is a cross section of the device along the line IV—IV in FIG. 1.

FIGS. 3 and 4 schematically illustrate an embodiment of a support surface 4, in which a tension element 45 is saddle-shaped and has carriers 5, which are secured to it with spacing from one another. The tension element 45, which can be formed by a roller chain, runs on a guide rib 46 secured to a carrier 47.

FIGS. 1 and 2 further illustrate a plurality of printed sheet feeders, with one being indicated by an arrow B, that load the gathering segment 2 consecutively with printed sheets.

FIGS. 1 and 2 depict the course of two printed sheets 3, 7 from right to left according to the arrow F. Following the first printed sheet 3 transported from the right by the conveyor apparatus 6, a second printed sheet 7 is set down by the sheet feeder B. At this stage, the rear edge of the second sheet 7 does not align with the rear edge of the first printed sheet 3. The rear edges of the printed sheets must be aligned for further processing. The rear edges of the printed sheets are to be aligned against the carrier 5. Further along the path, the printed sheet 7' has reached the end position on the conveyor apparatus 6, and its rear edge 8 is now located at the carrier 5'.

For executing the method of aligning the rear edges of the printed sheets against the carrier 5, a sheet feeder (not shown) on the right side in FIGS. 1 and 2 positions a first printed sheet 3 astride the gathering segment 2, and a carrier of the conveyor apparatus grips the rear edge immediately thereafter. Although relatively favorable sliding conditions exist between the support surface 4 and the first printed sheet 3, the transfer apparatus of the invention can also be associated with the sheet feeders.

The printed sheet 3 reaches the operational region of the transfer apparatus 9 associated with the sheet feeder B, the region being marked by an arrow, and the front edge 10 of the one leg 11 has traveled between the support surface 4 and a guide apparatus 12 spaced from the support surface of the side. The guide apparatus 12 is adjustably connected to the base 14 of the device 1 by a carrier apparatus 13. FIGS. 1,2 and 3 illustrate the elements used to adjust the guide apparatus 12. A guide tab 15 serving to conduct compressed air, together with the support surface, from a lateral guide gap 16, through which the conveyor apparatus 6 transports a respective leg 11 or plurality of legs 11 of printed sheets that were transferred by the upstream sheet feeders. The front end of the guide tab 15, seen in the conveying direction, and the support surface 4 form a funnel-shaped intake opening 17. Behind the intake opening 17, a protruding plate 18 is vertically adjustable for adjusting the height of the guide tab 15 in a guide slot 19 of a downward-projecting lever arm 20. The protruding plate 18 is secured to the outside of the guide tab 15. For changing the guide gap 16 in terms of the distance from the guide tab 15, the lever arm 20 is seated with its upper end in a support 21 secured to the base 14. A set screw 22 serves in seating the lever arm 20 and is screwed to the support 21. The set screw has a disk spring 23 that is tensed between the screw head and the lever arm 20 seated on the bearing segment. The lower end of the lever arm 20 is provided with a ball handle 24.

The thread-side end of a hexagon-head screw 25 penetrates the lever arm 20 and impacts a stop surface 26 embodies at the support 21. The screw 25 effects a change in the distance between the support surface 4 and the guide tab 15 during a rotation. As can be inferred from FIGS. 1 through 4, compressed air can be supplied to the guide gap 16 via the guide tab 15 embodies as a line. A bore 27, extending up to the rear end of the guide tab 15 and over nearly the length of the guide tab 15, is provided for this purpose. The line has discharge openings 28 for supplying compressed air with openings being provided at least in the rear region of the guide tab 15 and being oriented upward. The line is supplied via connected connecting bores 29 in the plate that is connected to the guide tab 15. The connecting bores 29 are in turn connected to a connectable compressed-air source (not shown). Additional, downward-oriented discharge openings 39 of a separate bore 40 with a separate connector 41 and openings being distributed over nearly the entire length of the guide tab 15 can prevent a possible folding of the printed sheet corners, particularly those of the inside legs 11 hanging down, due to supplied compressed air.

The transfer apparatus 9 has a stop apparatus 31 at the end of the guide tab 15. The stop apparatus 31 is for acting on the leg 11 of a printed sheet 3 that was lifted from the support surface 4 by the guide tab. The stop apparatus 31, a component of the transfer apparatus 9, has a stop 33 that can pivot on an adjustable carrier arm or support 32 that is connected to the base 14. In the operating position, the stop 33 penetrates the conveying path of the leg 11 of a printed sheet 3 that hangs down. The conveying path extends approximately parallel to the gathering segment 2. The stop apparatus is under the pressure of a torsion spring 34 counter to a pivot limit 35 on the carrier arm 32. This action shifts the top printed sheet 7 so that its rear edge 8 rests against the carrier 5'. The advancing motion of the conveyor apparatus 6 subsequently causes the front edge 10 of the printed sheet 7 to lift the stop 33 from the conveying path of the leg 11, counter to the force of the torsion spring 34, through a pivoting movement. The force of the torsion spring 34 is tensed at a screw 42 that constitutes the pivoting axis of the stop 33. This force can be changed through the rotation of the screw 42. The stop 33 can be adjusted both in height and laterally through a detachable clamp connection 36 (FIG. 4).

At the end of the guide tab 15, oriented in the conveying direction F, the tab has a recess 37, into which the stop 33 projects in the operating position, so that the leg 11 affected by the impact can lie completely against the guide tab 15 until the impact.

For enhancing the rigidity of the leg 11 at the time of impact, a guide rail 38, which holds the leg 11 against the guide tab 15, is provided opposite the guide tab 15, approximately at the height of the recess 37. The guide rail 38 is adjustably secured to the support.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for gathering and conveying a plurality of printed sheets over a conveying path, each sheet having a front edge and a rear edge with respect to a direction of conveyance, the device comprising:

a conveyor device presenting a gathering segment and having a saddle-shaped support surface adaptable to be loaded by sheet feeders disposed along the gathering segment with a plurality of sheets that have legs straddling the saddle-shaped support surface;

driven carriers disposed on the conveyor device and spaced apart from one another, wherein the rear edge of at least one of the sheets straddling the saddle-shaped support surface along the gathering segment is separated from an associated driven carrier;

a guide apparatus arranged to raise to least one leg of the at least one sheet away from the saddle-shaped support surface; and a stop apparatus projecting into the conveying path of the at least one raised leg and gripping the front edge of the at least one raised leg, wherein the stop apparatus is removed from the conveying path by the at least one sheet.

2. The device according to claim 1, further comprising at least one sheet feeder for loading sheets onto the conveyor device.

3. The device according to claim 2, wherein the guide apparatus and the saddle-shaped support surface define a guide gap on at least one side of the saddle-shaped support surface for at least one leg of the printed sheets without at least one raised leg.

4. The device according to claim 3, wherein the guide gap is adjustable by a lateral adjustment of the guide apparatus.

5. The device according to claim 3, wherein the guide apparatus includes at least one line of alternating upward and downward oriented discharge openings for guiding compressed air.

6. The device according to claim 1, wherein the guide apparatus includes a guide tab having a funnel shaped intake opening.

7. The device according to claim 1, wherein the stop apparatus includes a latch stop for impacting and gripping the front edge of the at least one raised leg.

8. The device according to claim 7, wherein the latch stop is adaptable to be raised out of the conveying path, counter to a force, by the front edge of the raised leg when the rear edge of the at least one printed sheet with the raised leg is moved into contact with the associated carrier.

9. The device according to claim 8, wherein the force can be altered.

10. The device according to claim 8, wherein the latch stop has a pivot limit to establish an operating position.

11. The device according to claim 7, further comprising an adjustable support for securing the latch stop.

12. The device according to claim 7, wherein the guide tab defines a recess to enable the latch stop to project in the conveyor path.

13. The device according to claim 7, further comprising a guide rail that acts on the at least one raised leg prior to reaching the latch stop.

14. A method for gathering and conveying a plurality of printed sheets over a conveying path, each sheet having a front edge and a rear edge with respect to a direction of conveyance, the method comprising the steps of:

consecutively loading the plurality of printed sheets onto a conveyor apparatus that includes a saddle-shaped support surface with legs of the printed sheets straddling the saddle-shaped support surface and driven carriers secured to a circulating tension element, wherein the rear edge of at least one the sheets straddling the saddle-shaped support surface is separated from an associated driven carrier and holding at least one leg of the at least one sheet at a distance from the support surface until a stop apparatus acts on the front edge of the at least one leg and displaces the at least one sheet so that the rear edge of the at least one sheet impacts the associated driven carrier and wherein the stop apparatus is removed from the conveying path by the at least one sheet.

* * * * *